US005887595A

United States Patent [19]

Draghetti et al.

[11] Patent Number: 5,887,595

[45] Date of Patent: Mar. 30, 1999

[54] FILTER ASSEMBLY MACHINE

[75] Inventors: Fiorenzo Draghetti, Medicina; Salvatore Rizzoli, Bologna, both of Italy

[73] Assignee: G.D Societa' Per Azioni, Bologna, Italy

[21] Appl. No.: 46,477

[22] Filed: Mar. 23, 1998

[30] Foreign Application Priority Data

Mar. 24, 1997 [IT] Italy ..... B097 A 0173

[51] Int. Cl.[6] ..... A24C 5/47; A24C 5/10

[52] U.S. Cl. ..... 131/29; 131/27.1; 131/32; 131/57; 131/58; 131/90; 131/93; 131/94

[58] Field of Search ..... 131/93, 94, 27.1, 131/29, 32, 34, 57, 58, 90

[56] References Cited

U.S. PATENT DOCUMENTS 4,848,371 7/1989 Belvederi ..... 131/94
5,715,838 2/1998 Dyett ..... 131/94

FOREIGN PATENT DOCUMENTS 0620983 10/1994 European Pat. Off. .
2584579 1/1987 France .

OTHER PUBLICATIONS

Abstract of FR 2584579 dated Mar. 1987.

*Primary Examiner*—James Derrington
*Assistant Examiner*—Kevin Cronin
*Attorney, Agent, or Firm*—Ladas & Parry

[57] ABSTRACT

A filter assembly machine wherein a succession of tobacco articles, each defined by at least one cigarette portion aligned with a respective filter, and a succession of respective gummed strips are fed by a conveyor drum to a first and a second rolling wheel rotating about respective axes and having a number of peripheral axial cavities, each of which houses a respective roller defining, with the cavity, a rolling channel; the tobacco articles, once rolled to connect the cigarette portions and filters by means of respective strips, are transferred from the first and second rolling wheel to an output drum by means of conveyors having seats on the end of respective ribs engageable between pairs of adjacent rollers.

6 Claims, 1 Drawing Sheet

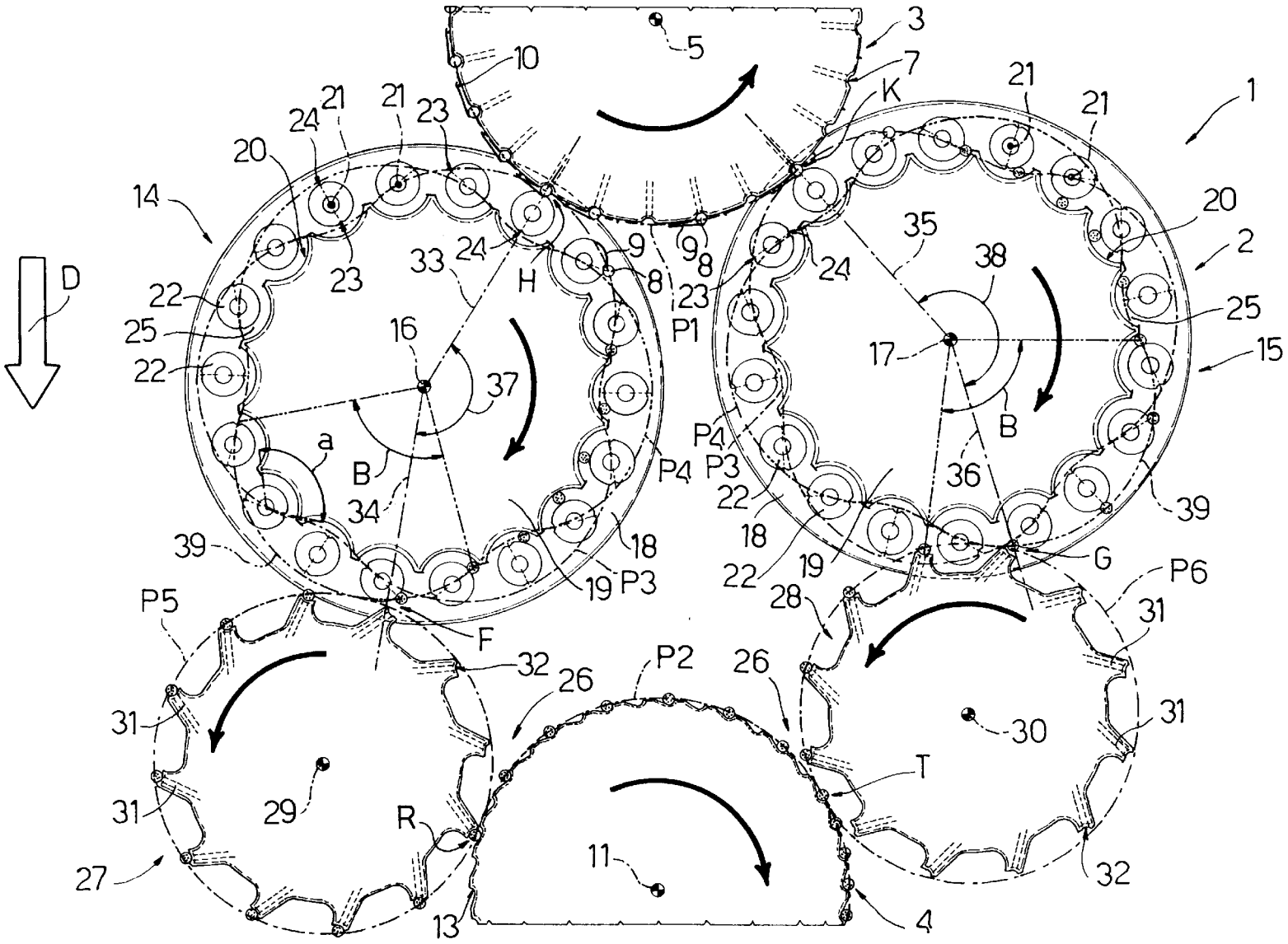
1
2
15
20
25
39
P6
31
32
21
G
30
38
B
36
35
17
3
7
K
T
4
24
19
28
18
22
26
5
8
23
P1
P4
P3
P2
9
11
10
H
37
F
13
R
16
34
a
29
14
P5
27
D

FILTER ASSEMBLY MACHINE

BACKGROUND OF THE INVENTION

The present invention relates to a filter assembly machine.

More specifically, the present invention relates to a filter assembly machine wherein filters are connected to cigarette portions by means of gummed strips of paper material, each of which is rolled about a respective tobacco article defined by two cigarette portions aligned axially with the interposition of a filter twice the length of a finished cigarette filter.

Such strips are rolled about the tobacco articles by means of a so-called rolling operation performed by feeding the articles and respective strips, by means of a conveyor drum, along a rolling channel of a width approximately equal to but no wider than the diameter of the articles. The channel is normally defined by a fixed plate facing the periphery of the conveyor drum, and which provides for frictionally rolling the articles backwards onto the respective gummed strips to form double cigarettes.

During the rolling operation, the double cigarettes being formed are rolled as described above at a speed which may only assume one value for each operating speed of the machine, and which, over and above a given value, inevitably results in tobacco fallout from the open ends of the cigarette portions.

By way of a solution to the problem, U.S. Pat. No. 4,848,371 relates to a filter assembly machine featuring a rolling station comprising a multiple-rolling wheel for transferring and rolling the articles between a supply drum and an output drum. The rolling wheel comprises a cylindrical body with a number of equally spaced peripheral cavities, each housing a revolving roller defining, with the respective cavity, a curved rolling channel of a width approximately equal to but no wider than the diameter of the article. Each roller has two diametrically opposite suction seats, into one of which an article is fed from the supply roller. As the roller rotates, the article, on abandoning the respective seat, travels at least once along the rolling channel, is wrapped inside the respective strip to form a double cigarette, and, each time it comes out of the rolling channel, is fed into the opposite seat. Each double cigarette is then transferred to the output drum.

While indeed enabling the articles to be rolled at a speed slower than that at which they are transferred between the supply and output drums, the above known filter assembly machine involves several drawbacks, due to the impossibility of using rollers of less than a given minimum diameter, without impairing the rolling operation or complicating the construction design of the rolling wheel.

On the other hand, small-diameter rollers would enable a reduction in the spacing of the rollers, and hence of the articles, on the rolling wheel, and an increase in the output of the machine for a given traveling speed.

The preference on known multiple-rolling filter assembly machines is to employ fairly large-diameter rollers, and subsequently reduce the spacing of the double cigarettes to avoid feeding them at too high a speed. Such a reduction, however, has been found to have a tendency to damage the double cigarettes, and is therefore to be avoided.

SUMMARY OF THE INVENTION

It is an object of the present invention to provide a filter assembly machine designed to overcome the aforementioned drawbacks.

According to the present invention, there is provided a filter assembly machine comprising a supply drum for supplying articles and gummed strips, each article comprising at least one cigarette portion and a filter aligned with and adjacent to each other; a rolling unit for winding a respective gummed strip about each cigarette portion and respective filter; and an output drum for successively evacuating the rolled articles; said rolling unit comprising a rolling wheel rotating about an axis and having a number of peripheral axial cavities, and a roller housed inside each cavity and defining, with the cavity, a rolling channel; each roller having a first seat for receiving a respective article from the supply drum and feeding said article to the rolling channel, and a second seat for withdrawing the article from the rolling channel; said machine being characterized in that the rolling unit comprises a first and a second said rolling wheel rotating in the same direction about respective axes; conveying means being provided to transfer the articles from the second seats of the first and the second rolling wheel to the output drum; and said conveying means having third seats located at the end of respective ribs, each of which is engaged between a respective pair of adjacent said rollers.

Using two rolling wheels, as opposed to one, has the advantage, on the one hand, of ensuring fairly high production despite feeding the articles, during the rolling operation, at fairly low speed along the respective rolling channels, but, on the other hand, has the disadvantage of having to transfer the articles successively to a single output drum by means of fairly cumbersome transfer means.

According to a preferred embodiment of the present invention, said conveying means comprise a first and a second transfer drum rotating in the same direction about respective axes, and for respectively transferring said articles from the first and second wheel to the output drum.

In the machine according to the preferred embodiment described above, the above drawback is substantially negligible, in that, unlike the machine described in U.S. Pat. No. 4,848,371—wherein each article is only unloaded off the rolling wheel upon the rolled article reaching the furthest point from the axis of the rolling wheel—the preferred embodiment described above, by featuring two transfer drums with ribs engageable between the rollers, provides for withdrawing each article at any point along an arc extending about the axis of the relative roller and complementary to the arc along which the relative rolling channel extends. As such, withdrawal points may be so selected as to position the two transfer drums close together and so select the best configuration in terms of size.

BRIEF DESCRIPTION OF THE DRAWING

The present invention will now be described by way of a non-limiting example with reference to the accompanying drawing, which shows a front view, with parts removed for clarity, of a preferred embodiment of the filter assembly machine according to the invention.

DETAILED DESCRIPTION OF THE INVENTION

Number 1 in the accompanying drawing indicates as a whole a filter assembly machine for producing filter-tipped cigarettes.

Machine 1 comprises a rolling unit 2; a supply drum 3 located upstream from unit 2; and an output drum 4 located downstream from unit 2 in a direction D. Supply drum 3 rotates anticlockwise about an axis 5 of rotation, and comprises a succession of seats 7 parallel to axis 5 and equally spaced with a spacing "L" about the periphery of drum 3. Each seat 7 provides for retaining a respective article 8 comprising, in known manner, two cigarette portions (not shown) aligned with each other at opposite ends of a double filter (not shown), i.e. a filter twice the length of a finished cigarette filter.

Articles 8 are fed in known manner to seats 7 together with respective gummed strips 9, each of which is positioned with one end resting on a mid portion of the outer periphery of respective article 8, and with the other end resting on a suction retaining element 10 located on the periphery of drum 3, downstream from each seat 7 with reference to the rotation direction of drum 3. Articles 8 and strips 9 are therefore fed to rolling unit 2 in an orderly stream, and in a succession with spacing "L", along a path "P1" defined by seats 7.

Output drum 4 rotates clockwise about an axis 11 of rotation parallel to axis 5, and comprises a succession of seats 13 parallel to axis 11 and about the periphery of drum 4. Seats 13 define a path "P2", and provide for retaining respective articles 8, each applied with a respective gummed strip 9.

Unit 2 comprises two identical rolling wheels 14 and 15, both rotating clockwise about respective axes 16 and 17 parallel to axis 5. Each wheel 14, 15 receives half the orderly stream supplied by drum 3, and comprises a cylindrical body 18 fitted integrally with a substantially cylindrical conveying and rolling element 19 coaxial with axis 16, 17. Element 19 has a number of axial peripheral cavities 20, each in the form of a cylindrical sector of angle "a" and positioned with its concavity facing outwards of element 19.

Each cavity 20 is engaged by a roller 22 coaxial with cavity 20 and fitted to cylindrical body 18 to rotate about a respective axis 21 parallel to axes 16 and 17. Each roller 22 has two axial suction seats 23 and 24 located at two diametrically-opposite portions of the peripheral surface of the roller, and for receiving and retaining an article 8. The surface of each roller 22 and the surface of each cavity 20 are knurled, and the diameter of each roller 22 is such that, between roller 22 and respective cavity 20, there is defined a passage 25—hereinafter referred to as a "rolling channel"—extending along an arc subtended by an angle equal to angle "a". Rolling channel 25 is of constant width approximately equal to but no wider than the diameter of article 8.

Each roller 22 is connected in known manner to body 18 to rotate clockwise, in the accompanying drawing, about respective axis 21 by means of a known gear train (not shown), the gear ratio "i" of which is such that each complete turn of body 18 corresponds to three complete turns of each roller 22 about respective axis 21, and, for each complete turn, seats 23 and 24 return to their original positions. The combined rotation of wheel 14, 15 and rollers 22 imparts to seats 23 and 24 a precession about axis 16, 17, so that seats 23 and 24 define respective cycloidal paths "P3" and "P4" in phase opposition to each other, and, when a seat 23 is at the maximum distance from axis 16, 17 of wheel 14, 15, the corresponding seat 24 is at the minimum distance from axis 16, 17 and vice versa.

Cycloidal path "P3" of wheel 14 is substantially tangent to path "P1" of drum 3 at a point "H", and seats 23 of rollers 22 of wheel 14 are synchronized with respective seats 7 equally spaced about drum 3 with a spacing equal to twice spacing "L". Similarly, cycloidal path "P3" of wheel 15 is substantially tangent to path "P1" at a point "K", and seats 23 of wheel 15 are synchronized with respective seats 7 equally spaced about supply drum 3 with a spacing equal to twice spacing "L", and which are offset by spacing "L" with respect to the seats 7 synchronized with seats 23 of wheel 14, so as to divide the stream of articles 8 supplied by drum 3 into two equal half-streams fed respectively to wheel 14 and wheel 15.

Each article 8 is fed by respective seat 23 into channel 25, in which article 8 leaves seat 23 and rolls between the surface of respective cavity 20 and the surface of respective roller 22. At the output of channel 25, article 8 engages respective seat 24 and so switches from path "P3" to path "P4".

Filter assembly machine 1 also comprises a transfer unit 26 between rolling unit 2 and output drum 4. Unit 26 comprises a transfer drum 27 for transferring articles 8 from wheel 14 to drum 4; and a drum 28 for similarly transferring articles 8 from wheel 15 to drum 4. Each drum 27, 28 rotates anticlockwise about a respective axis 29, 30 parallel to axes 16 and 17, and comprises a succession of axial ribs 31 equally spaced about the outer surface of drum 27, 28 with a spacing, at the free ends, substantially equal to that of rollers 22 about axis 16, 17, and sloping backwards with respect to the direction of rotation of drum 27, 28. The free end of each rib 31 has a respective suction seat 32 for retaining a respective article 8, and which, as it travels about respective axis 29, 30, defines a respective path "P5", "P6" for the rolled articles 8.

Drum 27 is so positioned that path "P5" is tangent to path "P4" of wheel 14 at a transfer point "F", which in turn is so located that a plane 33 through point "H" and axis 16 of wheel 14 forms, with a plane 34 through point "F" and axis 16 of wheel 14, and in the rotation direction of wheel 14, an angle 37 of less than 180°, i.e. that articles 8 are transferred from wheel 14 to drum 27 before seat 24 reaches the maximum distance from axis 16.

Drum 28 is so positioned that path "P6" is tangent to path "P4" of wheel 15 at a transfer point "G", which in turn is so located that a plane 35 through point "K" and axis 17 of wheel 15 forms, with a plane 36 through point "G" and axis 17 of wheel 15, and in the rotation direction of wheel 15, a second angle 38 of over 180°, i.e. that articles 8 are transferred from wheel 15 to drum 28 after seat 24 passes the maximum distance from axis 17.

Paths "P5" and "P6" are tangent to path "P2" of output drum 4 at respective transfer points "R" and "T", and seats 32 of drums 27 and 28 are synchronized with respective seats 13 of drum 4 so as to form said two half-streams once more into one stream.

In actual use, articles 8 and strips 9 are conveyed by drum 3 in one stream and in an orderly succession, and are fed onto wheels 14 and 15, each of which provides, as clearly understandable from the foregoing description, for rolling the articles as a respective half-stream of articles 8 is fed between points "H" and "F", "K" and "G".

Articles 8 are transferred from wheel 14, 15 to respective drum 27, 28 along a portion 39 of respective path "P4" about respective axis 16, 17, which portion is subtended by an angle "B" defined by the formula:

$$B=(360°-a)/i$$

where "a" is the angle of the sector defining cavity 20, and "i" is the gear ratio between rollers 22 and wheel 14, 15.

The transfer of articles 8 along portion 39 is made possible by ribs 31, each of which provides for inserting a respective seat 32 inside the gap between a respective pair of adjacent rollers 22, and for withdrawing article 8 both before and after respective seat 24 reaches the maximum distance from axis 16, 17.

This is particularly advantageous, as compared with withdrawing articles 8 from seats 24 at a maximum distance from axis 16, 17, by enabling drums 27 and 28 to be so located as to reduce the size of drums 27 and 28.

We claim:

1. A filter assembly machine comprising a supply drum (3) for supplying articles (8) and gummed strips (9), each article (8) comprising at least one cigarette portion and a filter aligned with and adjacent to each other; a rolling unit (2) for winding a respective gummed strip (9) about each cigarette portion and respective filter; and an output drum (4) for successively evacuating the rolled articles (8); characterized in that said rolling unit (2) comprises a first and a second rolling wheel (14, 15) rotating in the same direction about respective axes (16, 17); each said rolling wheel (14; 15) comprising a number of peripheral axial cavities (20), and a roller (22) housed inside each cavity (20) and defining, with the cavity (20), a rolling channel (25); each roller (22) having a first seat (23) for receiving a respective article (8) from the supply drum (3) and feeding said article to the rolling channel (25), and a second seat (24) for withdrawing the article (8) from the rolling channel (25); conveying means (27, 28) being provided to transfer the articles (8) from the second seats (24) of the first and the second rolling wheel (14, 15) to the output drum (4); and said conveying means (27, 28) having third seats (32) located at the end of respective ribs (31), each of which is engaged between a respective pair of adjacent said rollers (22).

2. A machine as claimed in claim 1, characterized in that said conveying means comprise a first and a second transfer drum (27, 28) rotating in the same direction about respective axes (29, 30) and for respectively transferring said articles (8) from the first and second rolling wheels (14, 15) to the output drum (4).

3. A machine as claimed in claim 2, characterized in that said ribs (31) are equally spaced about the periphery of said two transfer drums (27, 28), and slope backwards with respect to said rotation direction of the transfer drums (27, 28).

4. A machine as claimed in claim 1, characterized in that said first seats (23) travel along respective first cycloidal paths (P3) about the axes (16, 17) of the respective rolling wheels (14, 15); and said second seats (24) travel along respective second cycloidal paths (P4) extending about the axes (16, 17) of the respective rolling wheels (14, 15) and in phase opposition with respect to the first cycloidal paths (P3).

5. A machine as claimed in claim 4, characterized in that the supply drum (3) comprises a succession of fourth seats (7) arranged with a constant spacing (L) and movable along a third path (P1); and in that said third path (P1) is tangent at a first point (H) to the first cycloidal path (P3) of the first rolling wheel (14), and at a second point (K) to the first cycloidal path (P3) of the second rolling wheel (15); the first seats (23) of the first rolling wheel (14) being synchronized with respective said fourth seats (7); and the first seats (23) of the second rolling wheel (15) being synchronized with respective said fourth seats (7) offset by said spacing (L) with respect to the fourth seats (7) synchronized with the first seats (23) of the first rolling wheel (14).

6. A machine as claimed in claim 2, characterized in that the third seats (32) of the first transfer drum (27) are movable along a fourth path (P5) tangent at a third point (F) to the second cycloidal path (P4) of the first rolling wheel (14); the third seats (32) of the second transfer drum (28) are movable along a fifth path (P6) tangent at a fourth point (G) to the second cycloidal path (P4) of the second rolling wheel (15); a first plane (33) through said first point (H) and the axis (16) of the first rolling wheel (14) forms, with a second plane (34) through said third point (F) and the axis (16) of the first rolling wheel (14), and in said rotation direction of the first rolling wheel (14), a first angle (37) of less than 180°; and a third plane (35) through said second point (K) and the axis (17) of the second rolling wheel (15) forms, with a fourth plane (36) through said fourth point (G) and the axis (17) of the second rolling wheel (15), and in said rotation direction of the second rolling wheel (15), a second angle (38) of over 180°.

* * * * *